United States Patent [19]

Lee

[11] 4,206,860

[45] Jun. 10, 1980

[54] AIR DISSIPATOR APPARATUS FOR AIRJET TOW PUDDLING

[75] Inventor: Benedict M. Lee, Kingsport, Tenn.

[73] Assignee: Eastman Kodak Company, Rochester, N.Y.

[21] Appl. No.: 970,071

[22] Filed: Dec. 18, 1978

[51] Int. Cl.[2] ..... B65H 17/32

[52] U.S. Cl. ..... 226/97; 19/66 T

[58] Field of Search ..... 226/97, 95; 28/1, 21; 19/66 T, 205, 150, 161; 406/195

[56] References Cited

U.S. PATENT DOCUMENTS

| | | | |
|---|---|---|---|
| 2,909,827 | 10/1959 | Waugh | 28/1 |
| 3,580,445 | 5/1971 | Moore, Jr. | 226/97 |
| 4,085,881 | 4/1978 | Roberson | 226/95 |

*Primary Examiner*—Leonard D. Christian

*Attorney, Agent, or Firm*—Malcolm G. Dunn; Daniel B. Reece, III

[57] ABSTRACT

Filamentary tow is puddled into a container from an air jet through an air dissipator apparatus, which slows the air-propelled tow by the tow impinging upon the dog-legged surfaces along the flow path within the apparatus and ricocheting therefrom while the propelling air is dissipated from the tow as the tow moves along the flow path and out of the apparatus for subsequent disposition into a container or the like that may be positioned below the air jet and the air dissipator apparatus connected to the end of the air jet.

7 Claims, 5 Drawing Figures

AIR DISSIPATOR APPARATUS FOR AIRJET TOW PUDDLING

BACKGROUND OF THE INVENTION

The present invention is directed to an air dissipator apparatus for connection to the outlet of an air jet by which filamentary tow is drawn from a supply source and is puddled into a container positioned beneath the air jet.

The yarn ends from a row of individual yarn spinning cabinets, such as from melt spinning cabinets, are usually combined and puddled in uniform back-and-forth manner into stainless steel containers to be later withdrawn and subsequently processed as by drafting, etc.

Yarn puddlers or yarn piddlers, as variously called, take many different forms. The Morehead et al patent, U.S. Pat. No. 3,281,913, which issued Nov. 1, 1966, discloses one form of puddling apparatus connected to an air jet and by which a rapidly moving yarn bundle is packaged in a container in a crosslaid or crisscross manner. The apparatus shown, over which the present invention constitutes an improved and different arrangement, is disclosed in the patent as being used for packaging into containers any type bundle, such as yarns, rovings, tows and the like. The apparatus includes a series of longitudinally extending spring fingers spaced apart in a circular array to form what is referred to in the patent as a "temporary storage chamber". The tow is forced under light pressure from the air jet into the temporary storage chamber while the air, which is entrained in the tow and is giving the tow kinetic energy for propulsion, is dissipated at an angle to the yarn flow through the tow in the storage chamber and through the spaced-apart fingers. The tow then falls substantially under its own weight to the tow bed within the container. The spring finger array is also called in industry a "spring bustle".

The tow bed, which is formed within the container directly beneath the air jet, is normally undisturbed because the air is being dissipated laterally through the tow and through the spaced-apart fingers. When the yarn movement to the air jet breaks down for whatever reason, the air jet then is unobstructed by the temporary storage of yarn within the spring bustle and the air from the jet directly hits the tow bed and disturbs its orderly arrangement. One problem arising when the tow bed is disturbed in this manner is that it makes it difficult for the operator to find the end of the yarn in the container. This is one of the problems that is eliminated by the dissipator apparatus of the present invention.

When the tow is puddled from the spring bustle, the yarn tends to have entanglements more closely spaced than when the tow is puddled from the apparatus of the present invention. This is due to the momentary hold-up of the yarn within the spring bustle or temporary storage chamber as the yarn piles up or is stuffed within the spring bustle and the compressed air from the air jet dissipates through the tow and through the spaced-apart spring fingers. It is theorized that since fewer entanglements occur in the yarn puddled from the apparatus of the present invention, drafting tension is distributed more evenly over the filaments during subsequent processing steps in which drafting occurs. This results in fewer end breaks during the drafting process, and hence results in increased processing yield.

SUMMARY OF THE INVENTION

The disclosed invention is thus directed to an air dissipator apparatus to be connected to the outlet end of an air jet by which filamentary tow is drawn from a supply source and is air puddled into a container positioned downstream of and below the jet flow axis of the air jet.

The air dissipator apparatus defines therewithin a flow path for the filamentary tow. The apparatus has two main parts, each of which extends a predetermined distance downstream from the jet outlet and on one side of the flow path. One of the main parts has portions that cross over the jet flow axis while the other main part remains on one side of the jet flow axis opposite the other main part.

The first-mentioned main part has a first portion extending downstream inwardly at an obtuse angle with respect to and across the jet flow axis and defining on its upstream surface a first surface below the jet outlet end and against which the filamentary tow initially impinges and ricochets therefrom. A second portion follows the first portion and is reversely bent to extend therefrom downstream outwardly at an obtuse angle with respect to and back across the jet flow axis. The second portion defines on its upstream surface a deflector surface that is downstream of and below the first surface and the jet outlet end and against which air and any fiber lubricant entrained in the air are deflected away from the flow path. A third portion follows the second portion and extends downstream essentially parallel to the jet flow axis.

The second-mentioned main part has a first portion extending downstream and beyond the reversely bent second portion of the first-mentioned main part, the first portion being generally parallel to the jet flow axis. A second portion follows the first portion and extends downstream inwardly at an obtuse angle with respect to and toward the jet flow axis. A third portion follows the second portion and extends therefrom downstream in a direction generally parallel to the jet flow axis. The first and second portions define surfaces against which the filamentary tow next impinges and ricochets therefrom in its movement along the flow path toward the container.

The first-mentioned main part and the second-mentioned main part may each be a series of fingers that are spaced a predetermined distance apart from each other and extend the length of the air dissipator apparatus. The fingers are essentially rigid members, the fingers for the first-mentioned main part being generally flat, and the fingers for the second-mentioned main part being generally round.

The deflector surface on the second portion of the first-mentioned main part may be a plate member against which air is deflected away from the flow path.

The second-mentioned main part may be adapted to pivot away from the first mentioned main part and from the jet flow axis, and may have some suitable means for urging the second main part in return to its initial nonpivoted position.

Alternately, the first surface on the first-mentioned main part may be defined along its length by spaced side-by-side members between which some of the air entrained in the filamentary tow diffuses, while the other portions of the first-mentioned main part and all of the portions of the second-mentioned main part may be solid surfaced structures.

DESCRIPTION OF THE PREFERRED EMBODIMENT

(a) Prior Art

Figure 1:
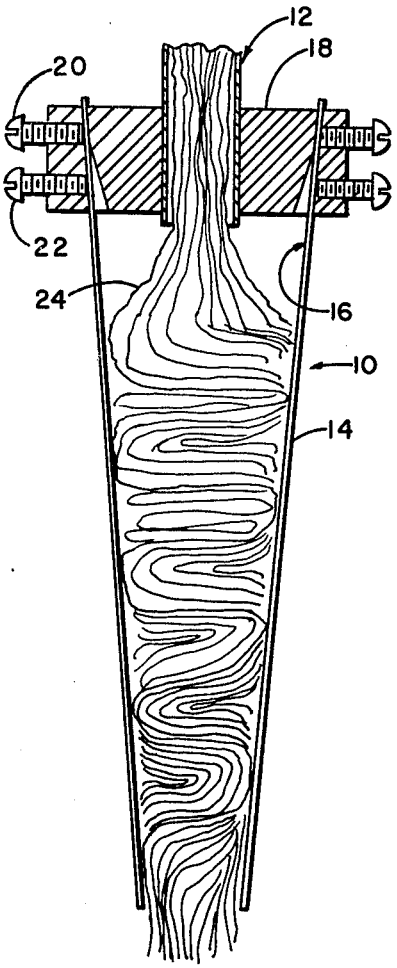
PRIOR ART FIG. 1
FIG. 1 is an elevational view partly in cross-section which shows the spring bustle of the prior art with some of the spring fingers removed.

In reference to FIG. 1, the spring bustle 10 of the prior art is shown connected to the end of an air jet 12. The spring bustle is the "temporary storage chamber" (22) identified as such and shown in the Morehead et al U.S. Pat. No. 3,281,913, which was mentioned above. Details of a suitable air jet that might be used may be obtained by reference to the patent.

The spring bustle 10 comprises a series of longitudinally extending spring fingers 14 which are spaced apart in circular array about the axis of the air jet end to define the temporary storage chamber 16 within the circular array.

The spring fingers 14 are attached to the end of the air jet 12 by means of a collar 18 and set screws (not shown) which threadingly extend through the collar into clamping, abutting engagement against the outer surface of the air jet end. An example of the size of the spring fingers was given in the Morehead et al patent as being made from spring steel stock 0.030"×0.250" wide×5.0" long. The temporary storage chamber was defined by eight spring fingers. The size, length and number of spring fingers used may vary, of course, depending upon size of the tow and other factors, as found by use. The spring fingers may also be made of other materials.

Each spring finger 14 may be secured to the collar 18 by a screw 20 and may also be adjusted to be deflected upwardly or outwardly to a predetermined extent relative to the temporary storage chamber 16 by an adjusting screw 22. The deflection inwardly of each spring finger reduces the spacing between adjacent fingers and tends to increase the tension overall of the spring bustle that is to confine tow temporarily within the storage chamber 16. Correspondingly, individual adjustment of each spring finger for movement outwardly from the storage chamber increases the spacing between adjacent fingers and tends to decrease the tension of the spring bustle.

In operation, the tow 24 is carried by high velocity fluid through the air jet 12 into the temporary storage chamber 16, as defined by the spring fingers 14, and folds upon itself within the storage chamber. The speed and most of the fluid or air are largely diminished, with the air being mostly dissipated at about right angles to the axes of the air jet through the folded or stuffed tow within the storage chamber. Other tow issuing from the air jet continuously forces a portion of the temporarily stored tow out of the open end of the storage chamber from which the tow falls under its own weight into a container (not shown) positioned below the air jet and spring bustle. The air jet 12 with the spring bustle is moved back and forth along a predetermined path by means described in the above-mentioned Morehead et al patent so that the tow is deposited in a particularly uniform manner upon the tow bed 26 within the container 28.

It has been found through experience in operating the above-described spring bustle that if the spring fingers are adjusted too tightly, a machine breakdown can occur from tension loss due to excessive backpressure in the air jet. On the other hand, if the spring fingers should be adjusted too loosely, the tow is blasted onto the tow bed within the container.

It has also been found that if some of the spring fingers are loose, the tow is split away from the loose spring fingers, and this action results in a poor build of the tow bed within the container.

It has been further found that the fluffiness of the tow changes as the compression (the tension adjustment of the spring fingers defining the temporary storage chamber) varies.

The operator has to make frequent adjustment of the spring bustle, depending upon the denier of the tow involved, the amount of lubricant on the tow, etc. The air pressure has to be maintained sufficiently high in order to maintain predetermined tension on the tow to continuously pull the tow from its source and to provide sufficient propulsion to the tow to lightly force it into the temporary storage chamber as well as to cause the temporarily stored tow to be forced out the open end of the storage chamber.

The back pressure upon the air jet also tends to vary due to the stick-slip effect occurring in the tow temporarily stored within the storage chamber. When the tow sticks within the storage chamber the back pressure increases, and then when the tow starts slipping more readily from the storage chamber the back pressure decreases. The increases or decreases of air thus affect the fluffiness of the tow, with more air causing more fluffiness and, correspondingly, less air, less fluffiness.

The hereindisclosed air dissipator apparatus resolves a number of problems associated with the use of the above-described spring bustle apparatus.

(b) Air Dissipator Apparatus

Figure 3:
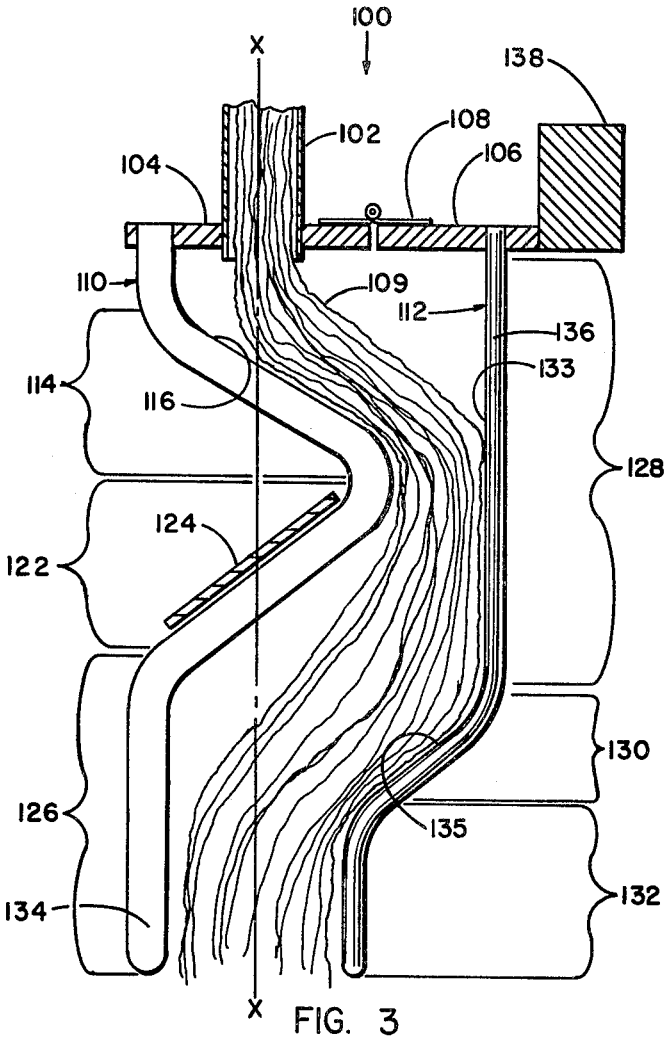
FIG. 3 is an elevational view partly in cross-section of the apparatus of the invention with some of the spring fingers removed to illustrate the flow of the tow through the apparatus.
Figure 2:
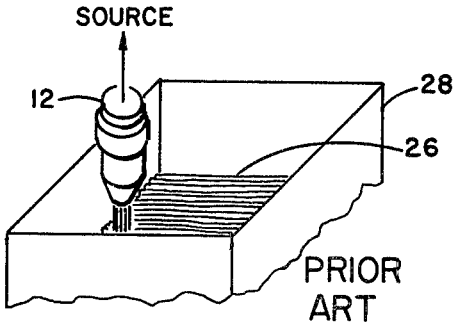
FIG. 2 is a partial schematic view of a yarn puddling apparatus of the prior art, illustrating the tow being puddled into a tow bed within a container.
Figure 4:
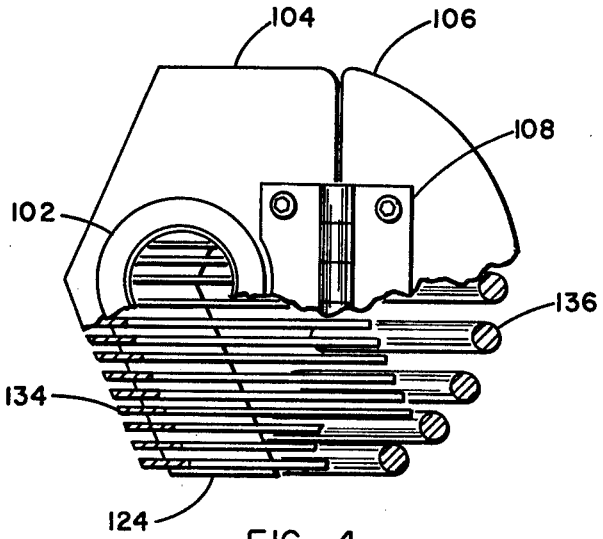
FIG. 4 is a plan view of the air dissipator apparatus, illustrating the hinged mounting plates partly broken away to show the flat dissipator and round guiding fingers, the view also showing the pattern arrangement of the dissipator and guiding fingers.

In reference to FIGS. 3 and 4, the air dissipator apparatus is shown at 100. The apparatus is shown in FIG. 2 as being connected to the end of an air jet 102 by means of a first mounting plate 104 which is suitably secured to the outer surface of the air jet end, and a second mounting plate 106, which may be connected to mounting plate 104 by means of a hinge 108. The purpose of the hinge will be discussed later.

As previously mentioned, the air dissipator apparatus 100 defines within its structure, as it encompasses about the end of the air jet 102, a flow path for the filamentary tow 109 as it flows or moves out of the air jet toward a container that would be positioned below and similar to that shown in FIG. 2. The apparatus has a first main part 110 suitably secured at its upstream end to the first mounting plate 104, and a second main part 112 suitably secured at its upstream end to the second mounting plate 106. Each main part extends longitudinally a predetermined distance downstream from the air jet outlet and is positioned on one side of the flow path.

The first main part 110 has a first portion 114, which extends downstream inwardly at an obtuse angle with respect to and across the jet flow axis X—X and defines on its upsteam surface a first surface 116 that is located below the jet outlet end and against which the filamentary tow 109 initially impinges and ricochets therefrom and through which some of the air entrained in the filamentary tow diffuses.

The first main part 110 has a second portion 122 following the first portion and being reversely bent to extend therefrom downstream and outwardly at an obtuse angle with respect to and back across the jet flow axis X—X. The second portion 122 defines on its upstream surface a deflector surface or plate 124 that is located below the first surface 116 and the jet outlet end and against which air and any fiber lubricant that may be entrained in the air are deflected away from the flow path. The deflector surface may be about 45° with respect to the axis of the air jet.

The first main part has a third portion 126 that follows the second portion 122 and extends therefrom downstream essentially parallel to the jet flow axis X—X.

The second main part 112 has a first portion 128 extending downstream and beyond the reversely bent portion 122 generally parallel to the jet flow axis X—X.

The second main part 112 has a second portion 130 following the first portion 126 and extending therefrom downstream inwardly at an obtuse angle with respect to and toward the jet flow axis X—X.

The second main part 112 has a third portion 132 following the second portion 130 and extending therefrom downstream in a direction generally parallel to the jet flow axis X—X. The first portion 128 and the second portion 130 define surfaces 133, 135, respectively, against which the filamentary tow next impinges and ricochets therefrom in its movement toward the container that would be positioned below the air dissipator apparatus 100.

Preferably, both the first main part 110 and the second main part 112 may be formed from rigid finger-like members, as shown in FIGS. 3 and 4, to insure that as much air as possible can be dissipated before the tow leaves the flow path in the air dissipator apparatus 100. Thus the fingers for the first main part may be called the "dissipator fingers" 134, and the fingers for the second main part may be called the "guiding fingers" 136.

Both sets of fingers may be spaced apart in side-by-side relation a predetermined distance from each other, dependent upon the size of the denier of the filamentary tow being fed through the apparatus. The dissipator fingers 134 are flat rigid members and may, for example, be about 0.063" in thickness, and have a distance between adjacent fingers of about 0.063" to about 0.094". The guiding fingers are rod-like and may, for example, have a thickness of about 0.125" to about 0.250" and may have a gap between adjacent guiding fingers of about 0.094" to about 0.188". These dimensions are illustrative only and are not intended to be restrictive as to what has to be employed.

There is a reason why the fingers on one side of the apparatus are flat and the fingers on the other side are round. Round fingers are easier to bend into the configurations shown in the drawings than flat fingers. If, however, the fingers directly below the force of the air jet were to be round, there is the possibility that filaments from the tow would become wrapped around the round fingers and soon cause a yarn blockage of the apparatus. On the other hand, if flat fingers of sufficient width are used beneath the air jet, the force of the air jet would not be such as to cause the filaments to penetrate beyond the width of the flat fingers and wrap therearound.

The air dissipator apparatus 100 thus slows the tow by ricochet action along the flow path defined by the first and second main parts, which may otherwise be characterized as dog-legged. Since the tow is not being stuffed into the flow path as is the case with the spring bustle of the prior art, and as shown in FIG. 1, less air pressure is needed to pull the filamentary tow from its source and through the air jet and the air dissipator apparatus. The use of less air pressure means reduced costs, reduced noise and contamination of the area by air-bourne fiber lubricant, and also serves in some of the cases to reduce the fluffiness of the tow falling into the container (not shown) positioned below the air jet.

Since the tow is not being stuffed into the air dissipator apparatus, any entanglements in the tow occur at greater distances apart. This greater spacing has also meant that there are fewer breakdowns occurring in the tow processing that follows, during which the tow may be drafted.

Since also the tow moves continuously along the flow path of the air dissipator apparatus, there is no stick-slip effect as was generally the case with the spring bustle of the prior art. Thus the air pressure tended to remain essentially constant and there was seldom any variable back pressure occurring which would otherwise cause variable tension on the tow.

As previously mentioned, the second mounting plate 106 is connected to the first mounting plate 104 by a hinge 108. Should the filamentary tow, for whatever reason, become snagged within the dissipator apparatus, the weight of other tow propelled from the air jet will force the hinged second main part 112 to pivot away from the first main part 110 and thereby normally cause an automatic release of the tow from the air dissipator apparatus.

The weight 138, which is shown at one end of the upper surface of the second mounting plate 106 in FIG. 3 only, may serve to urge the second mounting plate in return to the initial non-pivoting position. The weight may also be replaced with a spring suitably connected to urge the second mounting plate back to its initial position.

Figure 5:
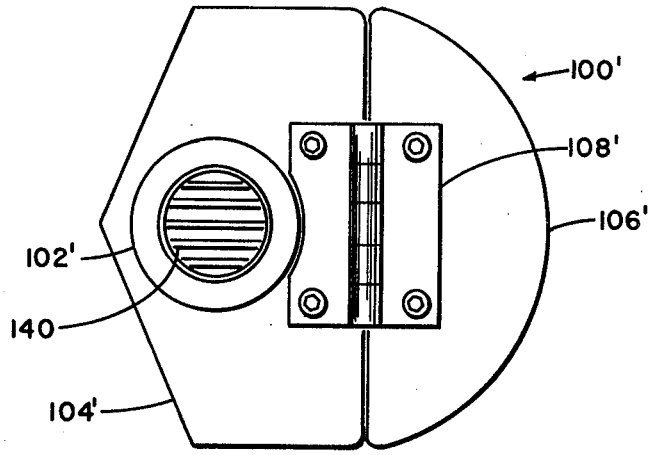
FIG. 5 is a plan view of an alternate embodiment of the air dissipator apparatus in which the first and second main parts would be solid members with the first surface of the first main part being illustrated through the connecting collar as a series of side-by-side members.

Although the first main part 110 and the second main part 112 are illustrated as being comprised of a series of spaced fingers, in an alternate embodiment, as shown in FIG. 5, the spaced fingers may also be replaced by solid-surfaced structures except for the area constituting the first surface 116 of the first main part 110. The first surface may be defined along its length by spaced side-by-side members 140 between which some of the air entrained in the filamentary tow diffuses. The side-by-side members, as they extend along the length of the first surface, assure that no part of the filamentary tow becomes trapped by any obstructions as the tow moves along the flow path. The members 140 thus extend along the same direction as the flow path.

The invention has been described in detail with particular reference to preferred embodiments thereof, but it will be understood that variations and modifications can be effected within the spirit and scope of the invention.

I claim:

1. An air dissipator apparatus for connection to the outlet end of an air jet by which filamentary tow is drawn from a supply source and is air puddled into a container positioned downstream of and below the jet flow axis of the air jet, the air dissipator apparatus defining therewithin a flow path for the filamentary tow and comprising:

first means extending a predetermined distance downstream from the jet outlet and on one side of the flow path and having (a) a first portion extending downstream inwardly at an obtuse angle with respect to and across the jet flow axis and defining on its upstream surface a first surface below the jet outlet end and against which said filamentary tow initially impinges and ricochets therefrom, (b) A second portion following the first portion and being reversely bent to extend therefrom downstream outwardly at an obtuse angle with respect to and back across the jet flow axis and defining on its upstream surface a deflector surface below said first surface and the jet outlet end and against which air and any fiber lubricant entrained in the air are deflected away from said flow path, and (c) a third portion following the second portion and extending therefrom downstream essentially parallel to the jet flow a second means spaced from and extending a predetermined distance from the jet outlet end on the side of the flow path opposite said first means and having (a) a first portion extending downstream and beyond said reversely bend second portion generally parallel to the jet flow axis, (b) a second portion following the first portion and extending therefrom downstream inwardly at an obtuse angle with respect to and toward the jet flow axis, and (c) a third portion following the second portion and extending therefrom downstream in a direction generally parallel to the jet flow axis; said first portion and said second portion defining surfaces against which the filamentary tow next impinges and ricochets therefrom in its movement along the flow path toward the container.

2. An air dissipator apparatus as defined in claim 1, wherein said first surface on said first means is defined along its length by spaced side-by-side members between which some of the air entrained in the filamentary tow diffuses.

3. An air dissipator apparatus as defined in claim 1, wherein said first means and said second means each comprises a series of fingers spaced a predetermined distance apart from each other and extending the length of said air dissipator apparatus.

4. An air dissipator apparatus as defined in claim 3, wherein said fingers are essentially rigid members.

5. An air dissipator apparatus as defined in claim 3, wherein said fingers for said first means are flat, essentially rigid members, and said fingers for said second means are round, essentially rigid members.

6. An air dissipator apparatus as defined in claim 1, and including means to which said second means is attached and by which said second means is adapted to pivot away from said first means and said jet flow axis, said included means also having means operative for urging said second means in return to its initial nonpivoted position.

7. An air dissipator apparatus as defined in claim 1, wherein said deflector surface on the second portion of said first means comprises a plate member.

* * * * *